US006183322B1

(12) United States Patent
Takahashi

(10) Patent No.: US 6,183,322 B1
(45) Date of Patent: Feb. 6, 2001

(54) OPERATION CABLE MOUNTING STRUCTURE OF OUTBOARD MOTOR

(75) Inventor: Satoru Takahashi, Hamamatsu (JP)

(73) Assignee: Suzuki Kabushiki Kaisha, Hamamatsu (JP)

( * ) Notice: Under 35 U.S.C. 154(b), the term of this patent shall be extended for 0 days.

(21) Appl. No.: 09/382,635

(22) Filed: Aug. 25, 1999

(30) Foreign Application Priority Data

Aug. 25, 1998 (JP) ..... 10-239145

(51) Int. Cl.[7] ..... B63H 20/32
(52) U.S. Cl. ..... 440/76; 440/77
(58) Field of Search ..... 440/900, 76, 77, 440/75, 84–87; 123/195 P, 195 C

(56) References Cited

U.S. PATENT DOCUMENTS 4,969,847 * 11/1990 Curtis et al. ..... 440/77

* cited by examiner

*Primary Examiner*—Ed Swinehart
(74) *Attorney, Agent, or Firm*—Oblon, Spivak, McClelland, Maier & Neustadt, P.C.

(57) ABSTRACT

An outboard motor is provided with an engine covered by an engine cover composed of a plurality of cover elements and formed with a port member having an cable insertion port through which operation cables are guided inside an outboard motor and an operation cable mounting structure is formed to the outboard motor, which comprises: a port member being arranged so as to straddle a plurality of the cover elements of the engine cover and composed of a first port member half provided to one of the cover elements and a second port member half provided to another one of the cover elements, the port member halves having openings opposed to each other so that when the port member halves are mated and joined together, the port member having a cable insertion port as a unit member having an opening; a grommet closing the opening of the cable insertion port; a partition wall section disposed in one of the first and second port member halves so as to divide the opening of the cable insertion port; and a boss member provided for the partition wall section which is secured to the one of cover elements through a bracket.

10 Claims, 5 Drawing Sheets

OPERATION CABLE MOUNTING STRUCTURE OF OUTBOARD MOTOR

BACKGROUND OF THE INVENTION

The present invention relates to an operation cable mounting structure of an outboard motor.

Generally, in an outboard motor, a throttling operation or gear shifting operation is performed through a remote control manner, and cables or the like, such as throttle cable and shift cable extending from a remote control unit provided to an operation seat of a hull, for example, and other cables such as electrical equipment cable, are guided into the outboard motor through a port member or section having a cable insertion port or hole formed to a front portion of an engine cover covering an engine of the outboard motor.

The engine cover of the outboard motor is usually composed of a plurality of sections including an upper cover section and a lower cover section, the lower cover section being further composed of a bilateral pair of cover elements and a front cover element.

As mentioned above, since the engine cover is usually divided into a plurality of sections, in some arrangements, the port member is formed so as to straddle the plural cover sections such as one side cover element and the front cover element. In such arrangements, however, one port member half is provided with the cable insertion port, but the other one port member half is not provided with the cable insertion port, and accordingly, no cable is inserted through other one port section half. For this reason, in a conventional arrangement, the location of the cable insertion port is limited in its arranging position, and in a certain case, it is necessary to separately form insertion port for the electrical equipment cables.

SUMMARY OF THE INVENTION

The present invention has been conceived to consider such defects encountered in the prior art mentioned above and to provide an operation cable mounting structure of an outboard motor eliminating the limitation of the location or layout of the cable insertion port and capable of mounting a plurality of cables in an assembled state.

This and other objects of the present invention can be achieved by providing an operation cable mounting structure of an outboard motor in which an engine is covered by an engine cover composed of a plurality of cover elements and formed with a port member having an cable insertion port through which operation cables are guided inside an outboard motor, the operation cable mounting structure comprising:

- a port member being arranged so as to straddle a plurality of the cover elements of the engine cover and composed of a first port member half provided to one of the cover elements and a second port member half provided to another one of the cover elements, the first and second port member halves having openings opposed to each other so that when the first and second port member halves are mated and joined together, the port member having a cable insertion port as a unit member having an opening;
- a grommet closing the opening of the cable insertion port;
- a partition wall section disposed in one of the first and second port member halves so as to divide the opening of the cable insertion port; and
- a boss member provided for the partition wall section which is secured to the one of cover elements through a bracket.

In a preferred embodiment, there is further provided a cable holder secured to the bass member by means of fastener for holding the cables. The cables are separately arranged by means of the partition wall section.

The grommet is formed with a plurality of cable insertion holes through which the cables are separately inserted and also formed with a slit extending from one of the cable insertion holes towards an outer peripheral edge of the grommet.

According to the operation cable mounting structure of the present invention of the structure mentioned above, it becomes possible to eliminate the limitation of the location or layout of the cable insertion port and to mount a plurality of cables in properly shared state. Furthermore, many other advantageous functions and effects are obtainable such as disclosed in the last portion of the present specification.

The nature and further characteristic features of the present invention will be made more clear from the following descriptions with reference to the accompanying drawings.

DESCRIPTION OF THE EMBODIMENT

A preferred embodiment of the present invention will be described hereunder with reference to the accompanying drawings.

Figure 1:
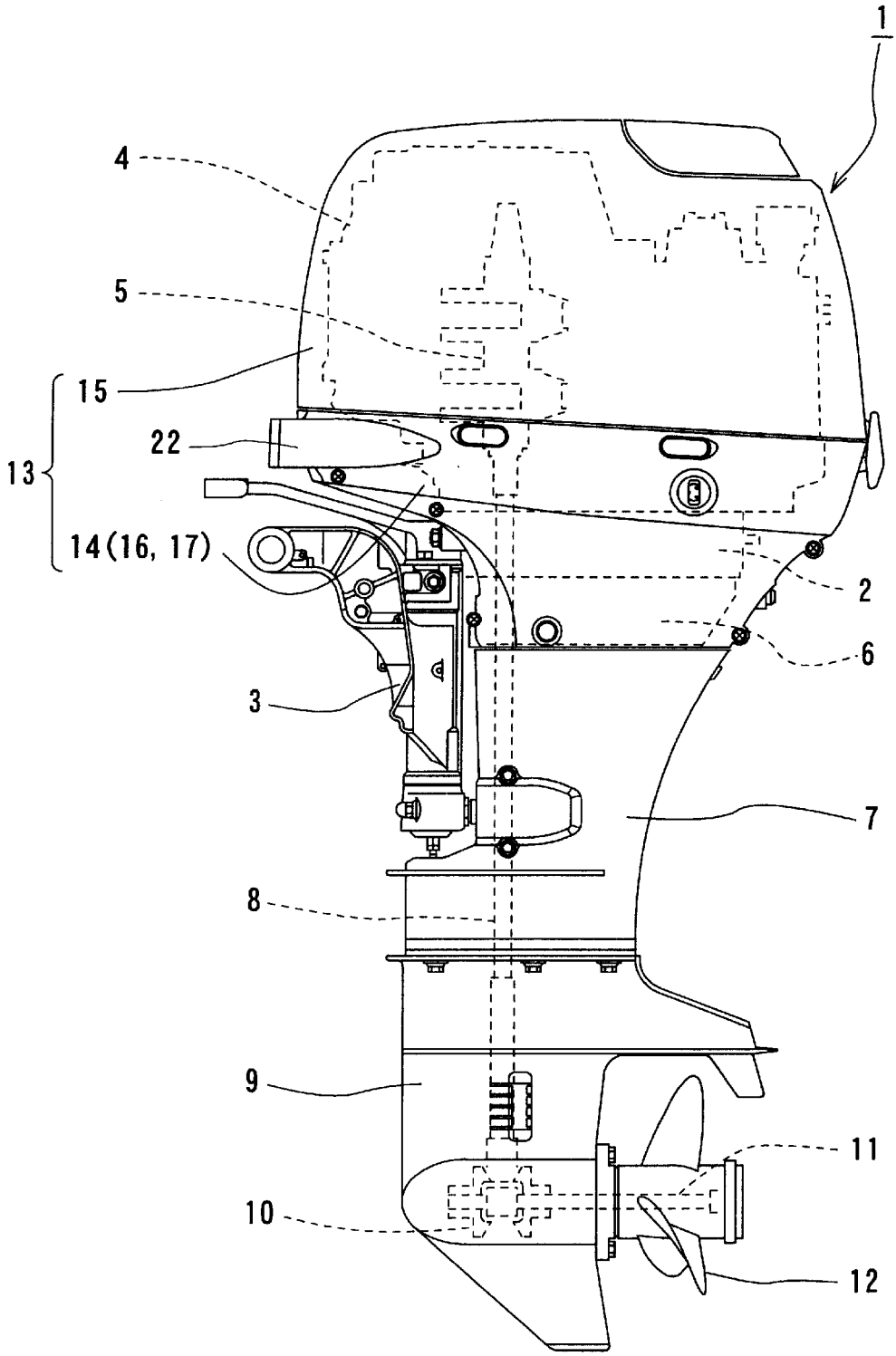
FIG. 1 is left side view of an outboard motor, in a state to be mounted to a hull, for example, provided with an operation cable mounting structure according to the present invention.

FIG. 1 is a left side view of an outboard motor to which the present invention is applied.

With reference to FIG. 1, an outboard motor 1 is provided with an engine holder 2 and mounted to a hull, for example, through a bracket 3 mounted to the engine holder 2. An engine 4 is disposed above the engine holder 2, and a crank shaft 5 is arranged in the engine 4 to extend vertically perpendicularly.

An oil pan 6 for storing a lubrication oil is arranged below the engine holder 2 and a shaft housing 7 is disposed further below the oil pan 6. A drive shaft 8, having an upper end operatively coupled with the lower end of the crank shaft 5, extends downward inside the shaft housing 7. The lower end of the drive shaft 8 extends into a gear case 9, disposed below the shaft housing 7, so as to be operatively engaged with a bevel gear 10 and a propeller shaft 11 in the gear case 9, through which a propeller 12 is driven to be rotated when the engine 4 is driven and the crank shaft 5 is hence rotated.

The surroundings of the engine 4, the engine holder 2 and the oil pan 6 of the outboard motor 1 are covered with an engine cover 13 which is composed of two divided cover sections, i.e. lower and upper cover sections 14 and 15 in the state of the outboard motor mounted to the hull, for example, such as shown in FIG. 1. The lower cover section 14 covers the lower portion of the engine 4 and the surroundings of the engine holder 4 and the oil pan 6 and the upper cover section 15 covers the upper portion of the engine 4.

Figure 2:
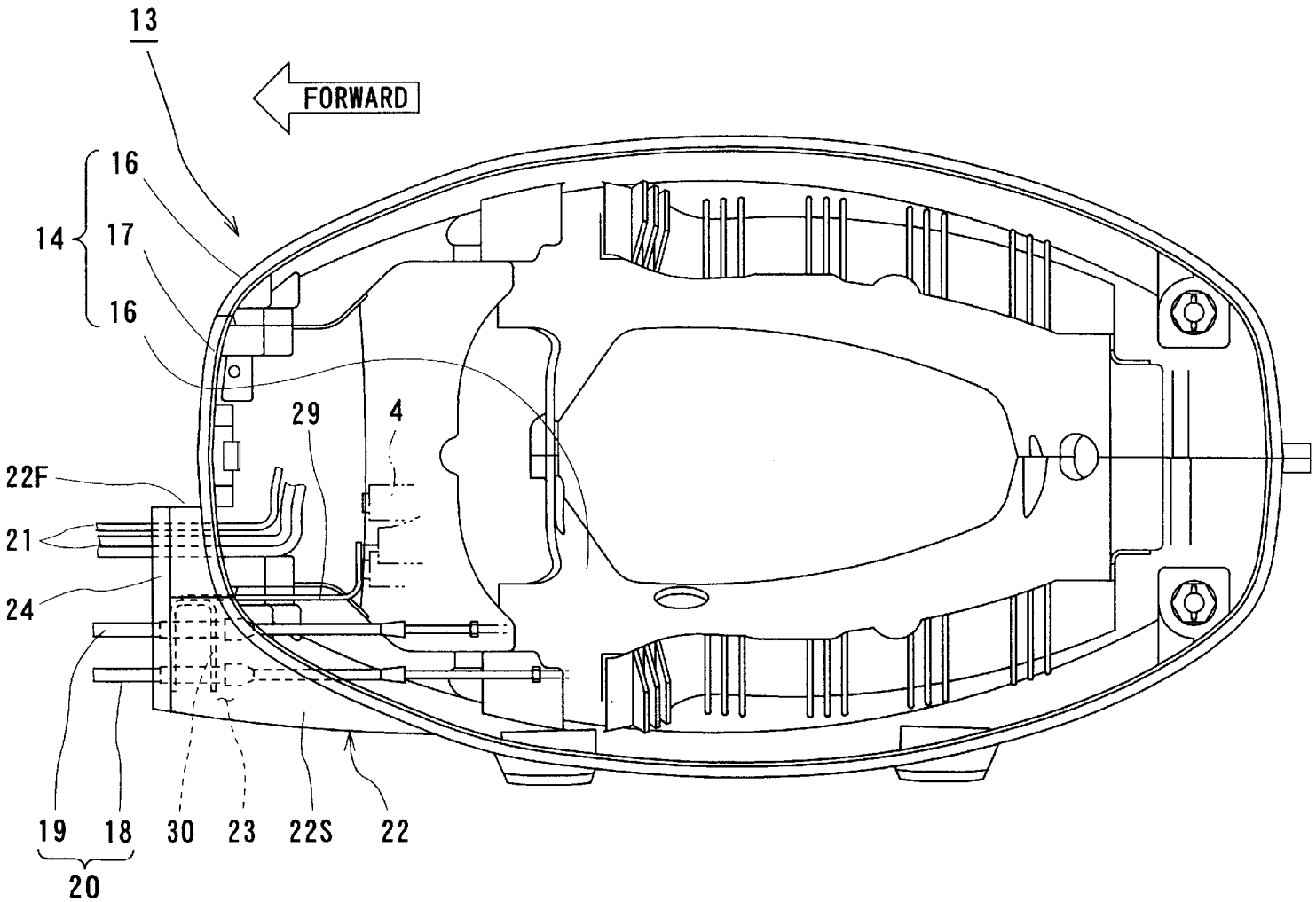
FIG. 2 is a plan view of a lower cover section of an engine cover of the outboard motor.

The lower cover section 14 is further composed of a bilateral pair of side cover elements 16, 16 and a front panel 17 as a front cover element 17 ("front" is indicated by an arrow "FORWARD" in FIG. 2). The side cover elements 16 are fixed to the outboard motor body through a sealing rubber, not shown, and the front panel 17 is fixed to the engine 4 through the bracket. An upper opened end portion of the lower cover section 14, as shown in FIG. 2, is closed by the upper cover section 15 to be detachable.

In the outboard motor 1, the operations of the throttle and the gear shift are performed by a remote control unit provided to an operation (driving) seat of a hull, not shown, through remote control cables 20 including a throttle cable 18 and a shift cable 19 extending from the remote control unit. The remote control cables 20 and other cables including such as electrical equipment cables 21 are guided into a body of the outboard motor 1.

In the embodiment of the present invention, a port member 22, having a cylindrical structure, for example, is provided for the front portion of the lower cover section 14 of the engine cover 13, and the port member 22 is formed with a cable insertion port 23 through which the cables 20 and 21 are guided inside the outboard motor 1.

Figure 3:
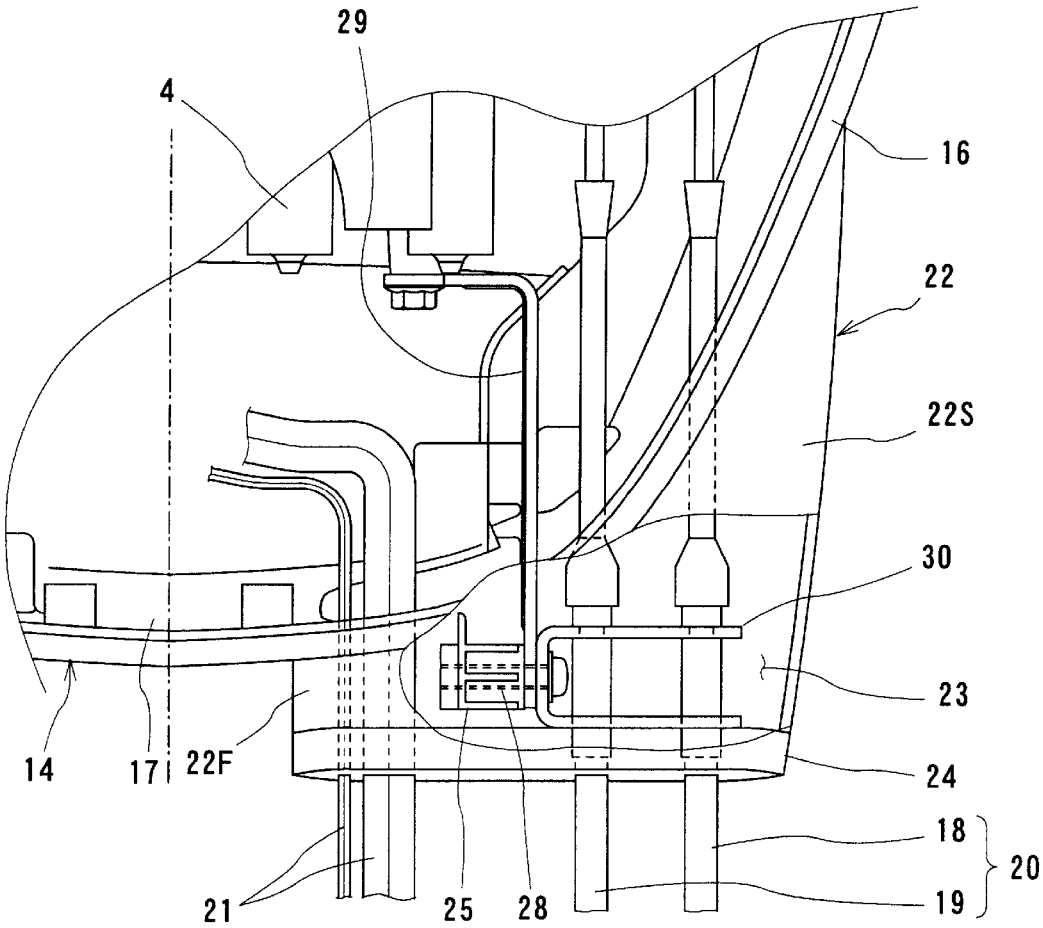
FIG. 3 is a plane view of a port section, in an enlarged scale, formed to the lower cover section.
Figure 4:
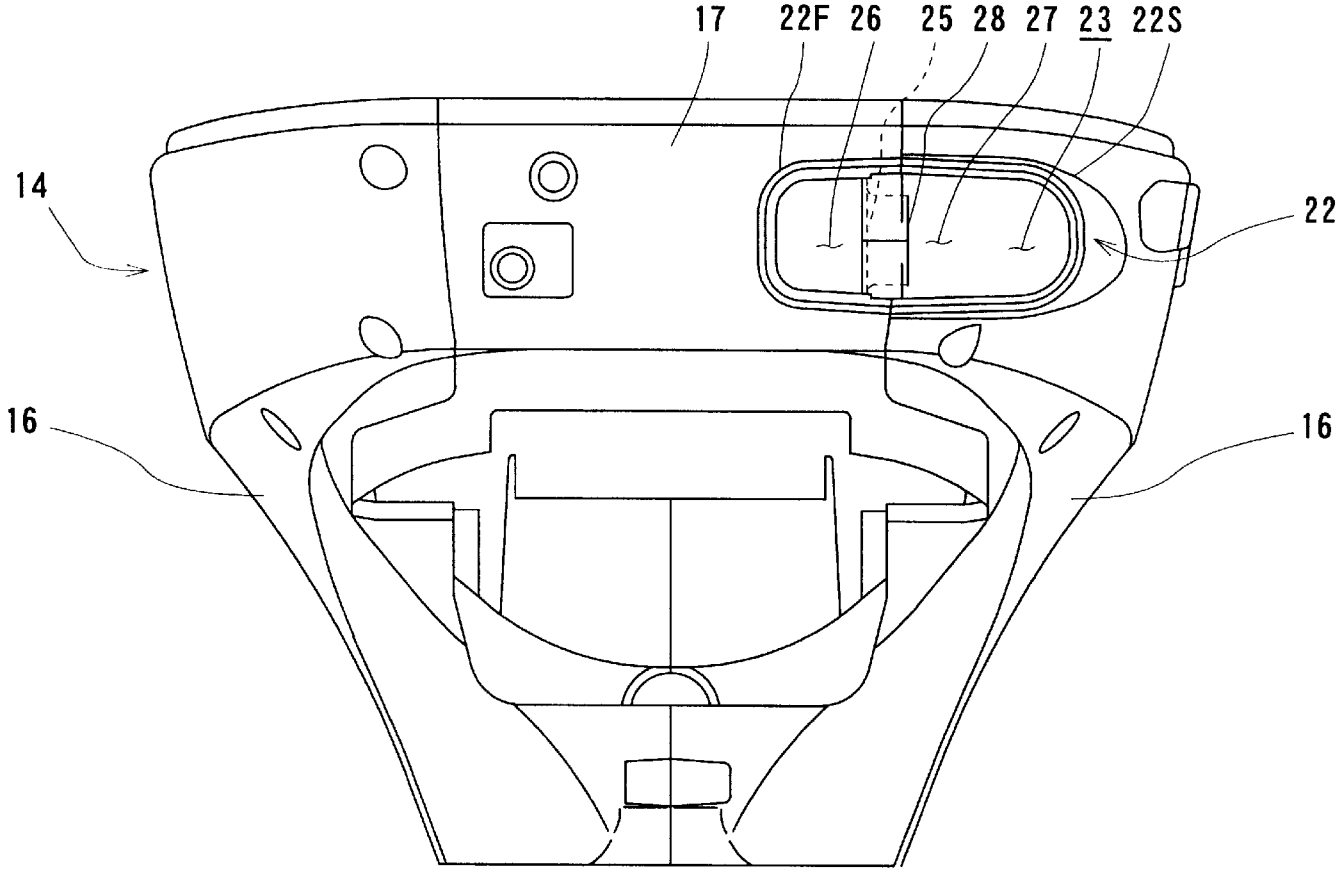
FIG. 4 is front view of the lower cover section to which the port section is formed.

FIG. 3 is an enlarged plan view of the port member 22 formed to the lower cover section 14, a portion of which being broken in FIG. 3, and FIG. 4 is a front view of the lower cover section 14 to which the port member 22 is formed.

Now, with reference to FIGS. 2, 3 and 4, the port member 22 is arranged so as to straddle on the front panel 17 as front cover element 17 and one of the paired side cover elements 16, 16 of the lower cover section 14 (left side one 16 in the "FORWARD" direction) in a manner projecting forward.

Figure 5:
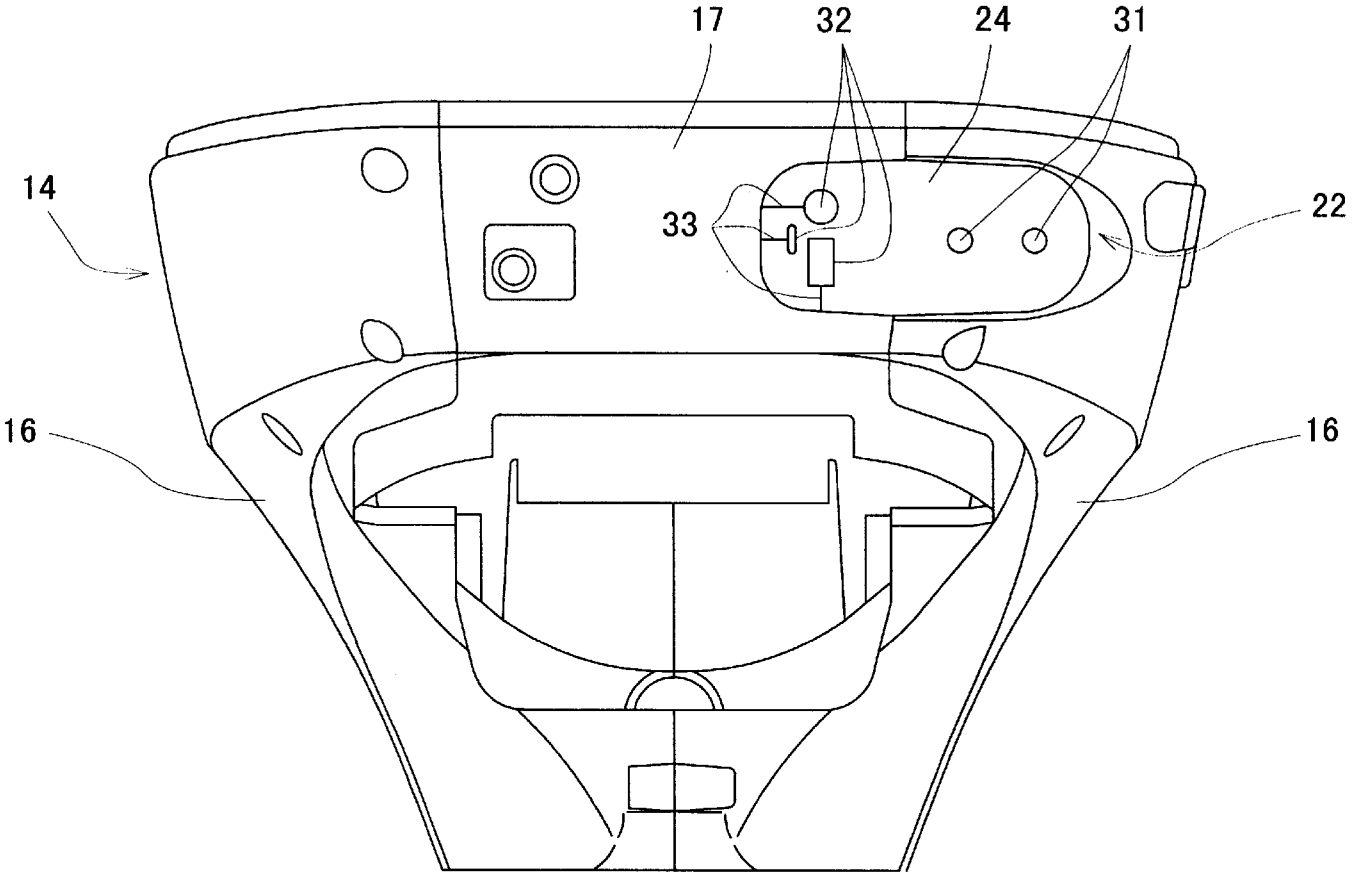
FIG. 5 is a front view of the lower cover section having a cable insertion port closed by a grommet.

The port member 22 is composed of a port section 22F formed on the side of the front panel 17 and a port section 22S formed on the side of the side cover element 16. Both the port sections 22F and 22S have openings, respectively, opposing to each other, and when coupled, both the port sections 22F and 22S constitutes the cable insertion port 23 as a unit having an opening which is closed by a grommet 24 thereby to keep a water-tight state in the engine cover 13. FIG. 5 shows a front view of the lower cover section 14 in which the cable insertion port 23 is closed by the grommet 24.

The opening of the cable insertion port 23 is divided vertically by a partition wall section 25 inside the port section 22F, for example, so as to partition the cable insertion port 23 into an electrical equipment cable passage 26 on the side of the front panel 17 and a remote control cable passage 27 on the side of the side cover element 16.

The wall section 25 is formed with a mounting boss 28, to which one end of a panel bracket 29 is secured, and the other end thereof is secured to the body of the engine 4, whereby the front panel 17 is mounted to the engine 4. A remote control cable holder 30 for holding the throttle cable 18 and the shift cable 19 is mounted to the mounting boss 28 of the front panel 17 by means of fastener.

As shown in FIG. 5, the grommet 24 closing the opening of the cable insertion port 23 is formed with a plurality of holes 31 for inserting the remote control cables 20 including throttle cable 18 and the shift cable 19 and a plurality of holes 32 for inserting the electrical equipment cables 20. Further, the grommet 24 is also formed with a slit 33 extending from at least one of the above insertion holes, for example, holes 32 in this embodiment, towards the outer peripheral edge portion of the grommet 24.

The function of the above embodiment will be described hereunder.

According to the present invention, the cable insertion port 23 having a relatively wide opening can be formed by joining, as a unit, the port section half 22F formed on the side of the front panel 17 and the port section half 22S formed on the side of the side cover element 16. Thus, the layout of the cable insertion port 23 can be considerably freely selected and the outer appearance of the cable insertion port 23 and the engine cover itself can be improved.

Furthermore, the wall section 25 is formed with the mounting boss 28, to which one end of the panel bracket 29 is secured, and the other end thereof is secured to the body of the engine 4, whereby the front panel 17 is mounted to the engine 4. A remote control cable holder 30 for holding the remote control cables 20 is mounted to the mounting boss 28 of the front panel 17 by means of fastener, and accordingly, the number of parts to be required can be eliminated.

Still furthermore, the opening of the cable insertion port 23 is partitioned, by the wall section 25, into the electrical equipment cable passage 26 and the remote control cable passage 27 so as to arrange the remote control cables 20 and the electrical equipment cables 21 separately independently by means of wall section 25 though these cables are disposed in one cable insertion. port 23. Therefore, the number of the grommet can be eliminated and, moreover, all the cables 20 and 21 will be able to easily handled outside the outboard motor 1.

Since the formation of the slit 33 extending from the insertion hole 32 of the grommet 24 towards the outer peripheral edge thereof eliminate the necessity of disconnecting the cables 20 and 21 at the time of dismounting the lower cover member 14.

It is to be noted that the present invention is not limited to the described embodiment and other changes or modifications may be made without departing from the scope of the appended claims.

What is claimed is:

1. An operation cable mounting structure of an outboard motor in which an engine is covered by an engine cover composed of a plurality of cover elements and formed with a cable insertion port having an opening through which operation cables are guided inside said outboard motor, said operation cable mounting structure comprising:

a port member being arranged so as to straddle said plurality of the cover elements of the engine cover and comprised of a first port member half provided to one of said cover elements and a second port member half provided to another one of said cover elements, said first and second port member halves having partial openings opposed to each other so that when said first and second port member halves are mated and joined together, said port member is formed as a unit member having said cable insertion port with said opening;

a grommet closing the opening of the cable insertion port;

a partition wall section disposed in one of said first and second port member halves so as to divide said opening of the cable insertion port; and a boss member provided for said partition wall section and secured to one of aid cover elements through a bracket.

2. An operation cable mounting structure of an outboard motor according to claim 1, further comprising a cable holder secured to said boss member by fastener and configured to bold said cables.

3. An operation cable mounting structure of an outboard motor according to claim 1, wherein said cables are separately arranged by said partition wall section.

4. An operation cable mounting structure of an outboard motor according to claim 3, wherein said grommet includes a plurality of cable insertion holes through which said cables are separately inserted, and a slit extending from one of said cable insertion holes towards an outer peripheral edge of the grommet.

5. An operation cable mounting structure for guiding at least one operation cable inside an outboard motor having an engine covered by an engine cover including a plurality of cover elements, comprising:

a plurality of port member portions each connected to a respective cover element and configured to form a port member having an opening when said cover elements are mated to form said engine cover, said at least one cable entering said outboard motor through said opening;

a grommet configured to substantially close said opening of said port member;

at least one partition wall portion provided on a respective one of said plurality of port member portions and configured to form a partition wall within said port member when said cover elements are mated to form said engine cover;

a boss member configured to attach said partition wall to a bracket fixed to said engine.

6. An operation cable mounting structure as claimed in claim 5, further comprising a cable holder configured to hold said at least one cable, said cable holder being fixed to said partition wall.

7. An operation cable mounting structure as claimed in claim 6, further comprising a bracket mounted on said engine and fixed to said partition wall.

8. An operation cable mounting structure as claimed in claim 5, wherein said one grommet further comprises at least one cable insertion hole through which a respective of said at least one cable is separately inserted.

9. An operation cable mounting structure as claimed in claim 8, wherein said grommet further comprises a slit extending from one of said at least one cable insertion hole towards an outer peripheral edge of said grommet.

10. An operation cable mounting structure for guiding at least one operation cable inside an outboard motor having an engine covered by an engine cover including a plurality of cover elements, comprising:

means for forming a port member having an opening when said cover elements are mated to form said engine cover, said at least one cable entering said outboard motor through said opening;

means for substantially closing said opening of said port member;

means for forming a partition wall within said port member when said cover elements are mated to form said engine cover;

means for attaching said partition wall to said engine.

* * * * *